US011649677B2

(12) United States Patent
Aguiluz Flores

(10) Patent No.: US 11,649,677 B2
(45) Date of Patent: May 16, 2023

(54) MOVABLE LADDER

(71) Applicant: Grupo Bimbo, S. A. B. de C. V., Mexico City (MX)

(72) Inventor: Armando Israel Aguiluz Flores, Jilotepec (MX)

(73) Assignee: GRUPO BIMBO, S.A.B. DE C.V., Mexico City (MX)

( * ) Notice: Subject to any disclaimer, the term of this patent is extended or adjusted under 35 U.S.C. 154(b) by 367 days.

(21) Appl. No.: 15/735,070

(22) PCT Filed: Sep. 30, 2015

(86) PCT No.: PCT/MX2015/000134
§ 371 (c)(1),
(2) Date: Sep. 25, 2018

(87) PCT Pub. No.: WO2016/200248
PCT Pub. Date: Dec. 15, 2016

(65) Prior Publication Data

US 2019/0017324 A1 Jan. 17, 2019

(30) Foreign Application Priority Data

Jun. 10, 2015 (MX) ..... MX/U/2015/000313

(51) Int. Cl.
*E06C 1/39* (2006.01)
*E06C 7/14* (2006.01)
(Continued)

(52) U.S. Cl.
CPC ..... *E06C 1/39* (2013.01); *E06C 1/397* (2013.01); *E06C 7/14* (2013.01); *E06C 7/16* (2013.01)

(58) Field of Classification Search
CPC ... E06C 1/39; E06C 1/397; E06C 7/14; E06C 7/16; E04G 1/28; E04G 1/30; E04G 1/34
See application file for complete search history.

(56) References Cited

U.S. PATENT DOCUMENTS 1,115,803 A * 11/1914 Gallagher ..... E06C 1/39 182/27
1,146,094 A 7/1915 Parr
(Continued)

FOREIGN PATENT DOCUMENTS

AU 604370 B 12/1990
CA 2 460 101 C 11/2007
(Continued)

OTHER PUBLICATIONS

CN 208455018 https://worldwide.espacenet.com/publicationDetails/biblio?DB=EPODOC&ll=0&ND=3&adjacent=true&locale=en_ep&FT=D&date=20190201&CC=CN&NR=208455018U&KC=U (Year: 2019).*
(Continued)

*Primary Examiner* — Marcus Menezes
(74) *Attorney, Agent, or Firm* — Crowell & Moring LLP; John C. Freeman

(57) ABSTRACT

Disclosed is a movable ladder formed by a structural element composed of a rear part and two sides, the lower part of the vertical structural elements of the ladder terminating in lateral projections in the form of an inverted "U" that provide the ladder with reliable support on the floor. The ladder is characterised in that it is provided with two collapsible lateral platforms and four wheels that can be raised or lowered to facilitate the movement of the ladder toward the work area.

9 Claims, 4 Drawing Sheets

(51) Int. Cl.
*E06C 1/397* (2006.01)
*E06C 7/16* (2006.01)

(56) References Cited

U.S. PATENT DOCUMENTS 2,062,473 A * 12/1936 Norton ..... E04G 1/34 182/208
2,362,170 A * 11/1944 Swaisgood ..... E06C 5/06 14/72.5
2,418,597 A * 4/1947 Neff ..... E06C 7/16 182/120
2,917,129 A * 12/1959 Grover ..... E04G 1/34 182/152
3,112,010 A * 11/1963 Mihalik ..... E06C 1/397 182/15
3,318,415 A * 5/1967 Christie, Sr. ..... E06C 7/16 182/116
3,684,055 A * 8/1972 Rice ..... E06C 1/397 182/180.1
4,004,652 A * 1/1977 Laboy-Alvarado ..... E06C 1/39 182/1
4,068,737 A * 1/1978 Lenz ..... E04G 1/20 182/69.6
4,155,424 A * 5/1979 Johnson ..... E04G 1/24 182/127
4,580,777 A * 4/1986 Johnson ..... A63B 23/0458 D25/63
4,787,111 A * 11/1988 Pacek ..... B65G 69/22 49/369
4,828,074 A * 5/1989 Combs ..... E04G 1/24 182/127
5,158,023 A * 10/1992 Allen ..... E04G 5/00 182/120
5,191,954 A 3/1993 Ledford
5,588,500 A * 12/1996 Yonahara ..... E04G 1/22 182/115
D403,783 S * 1/1999 Takai ..... D25/66
6,305,496 B1 * 10/2001 Bieszczad ..... E06C 1/39 182/15
6,523,640 B1 * 2/2003 Young ..... E06C 1/39 182/15
6,863,155 B2 * 3/2005 Wyse ..... E04G 1/30 182/118
6,902,034 B2 6/2005 Gibson et al.
7,845,469 B1 * 12/2010 Butler ..... E06C 7/14 248/210
8,302,734 B2 * 11/2012 Krock ..... E06C 1/39 182/84
8,622,173 B2 * 1/2014 Fuqua ..... B60R 3/005 182/64.1
10,358,871 B2 * 7/2019 Honeycutt ..... E04G 7/02
2004/0238278 A1 12/2004 Gibson et al.
2005/0103569 A1 * 5/2005 Winter ..... E04G 5/142 182/223
2008/0093166 A1 * 4/2008 Frolik ..... E06C 7/181 182/108
2011/0127111 A1 * 6/2011 Bennett ..... E06C 7/16 182/115
2011/0198153 A1 * 8/2011 Dufour ..... E04G 5/02 182/113
2013/0186710 A1 * 7/2013 Moss ..... E06C 7/185 182/104
2019/0177987 A1 * 6/2019 Neubauer ..... E04G 7/34

FOREIGN PATENT DOCUMENTS

CN 1572994 A 2/2005
CN 201048733 Y 4/2008
CN 201048735 Y 4/2008
DE 19856196 A1 * 6/2000 ..... E04G 1/28
EP 0814219 A1 * 12/1997 ..... E04G 1/34
GB 791282 2/1958
GB 1422237 A * 1/1976 ..... E04G 1/34

OTHER PUBLICATIONS

Written Opinion of the International Searching Authority dated Feb. 25, 2016 in International Application No. PCT/MX2015/000134 (English and Spanish languages) (8 pages).
International Search Report dated Feb. 25, 2016 in International Application No. PCT/MX2015/000134 (English and Spanish languages) (7 pages).
Office Action believed to regard corresponding Mexican patent application Mx/u/2015/000313. Date unknown. 8 Pages.

* cited by examiner

MOVABLE LADDER

The present application refers to a movable ladder, provided with folding side platforms for the placement of work tools or various articles for their subsequent placement on shelves, as well as with ascending and descending wheels to facilitate the attachment of the ladder in the workplace or its easy movement on the surface of the floor.

Currently, there are several types of ladders, some of them are of great length, which require for their use to be supported on a wall, a post or some other means that keeps them in an inclined position in order to carry out repairs or work at considerably great heights. There are also folding scissor-shaped ladders on the market, which are widely used in the repair areas, the pruning of low trees, etc. The ladder we are making reference to is a ladder with a construction and utility that has been designed to carry out repair work at low heights, to move various articles for their subsequent placement on shelves or for specialized work where it is required to transport on these ladders the tools and/or products that will be used in the repair of walls, or as already mentioned before, to transport on them diverse articles, which will be subsequently placed on shelves at lower heights.

The movable ladder of the invention essentially consists of a frame or metal structure, which supports at least two steps as well as two folding side platforms. This ladder can remain fixed when in use or can be moved by means of four casters, which facilitate the movement of this ladder towards the work area.

Most of the above-mentioned ladders are foldable type ladders having the purpose that once unoccupied, they can be stored occupying minimal spaces. It is worth mentioning that ladders that could be considered prior art are those protected in U.S. Pat. D1146094A, patent CN201048733Y, patent CN201048733Y, the English patent GB19551364A, in addition to many others, which can be considered as prior art without thereby invalidating the novelty of the movable ladder, which is the object of the present application.

OBJECTIVES OF THE INVENTION

It is an objective of the invention to provide a movable ladder, which is provided with elements that keep it stable while it is in use and which permits the transporting on it work tools or articles that are intended to be placed on shelves at a moderately elevated height.

Another objective of the invention is the construction and design of a movable ladder equipped with folding side platforms for the transportation of products and/or work tools.

It is another objective of the invention to provide a movable ladder with unique features, allowing the user to achieve variable heights for the placement of diverse articles on shelves of supermarkets or service stores, or to facilitate the repair of walls and/or some other services that must be carried out at a height greater than that available to an operator of average height.

The invention that is subject of the present application will be fully understood by means of the accompanying drawings, which fully illustrate the advantages that the movable ladder of the invention offers, advantages that distinguish it from other ladders of its kind.

DETAILED DESCRIPTION OF THE INVENTION

Figure 1:
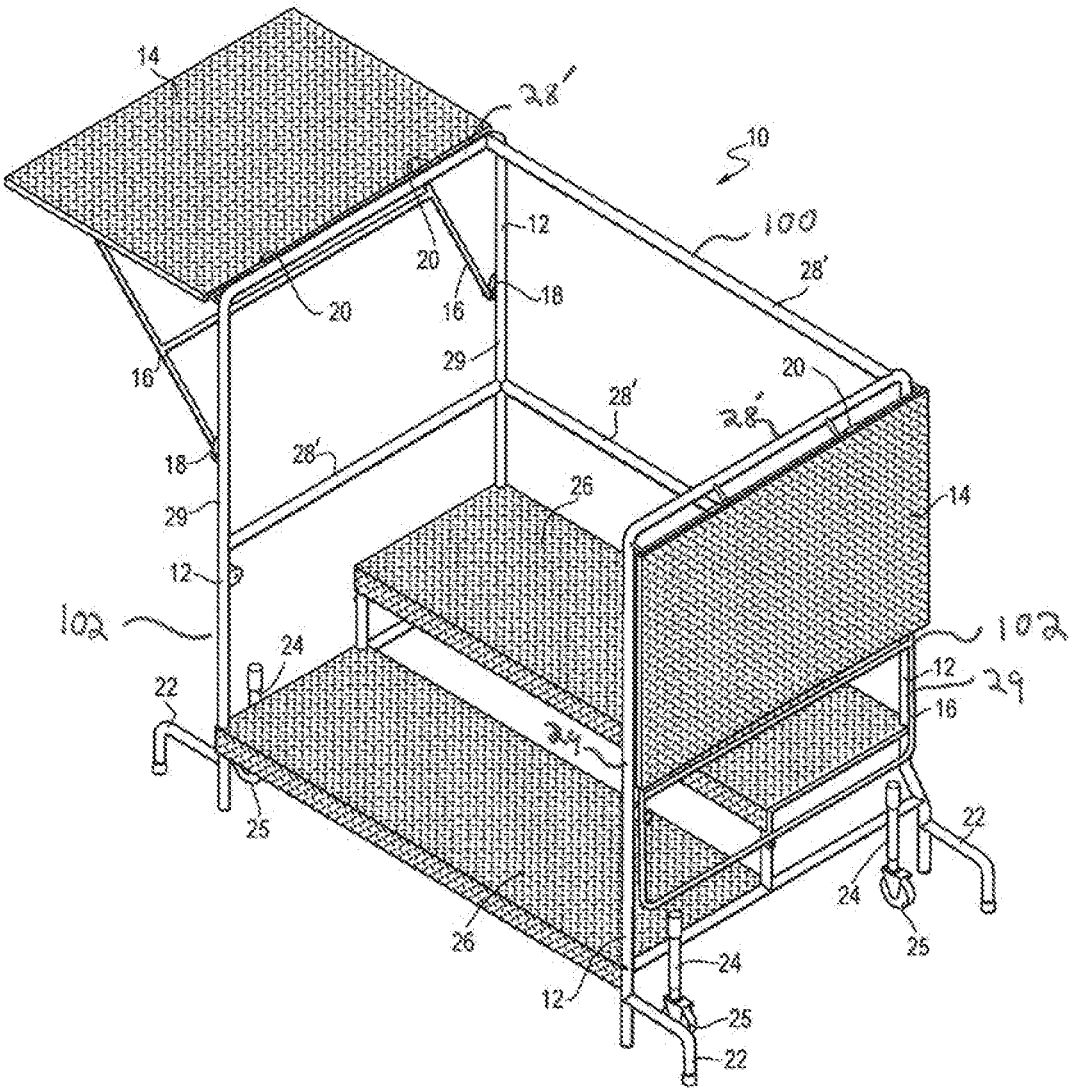
FIG. 1 is a perspective view of the movable ladder of the invention, in which one of its platforms is shown collapsed.
Figure 2:
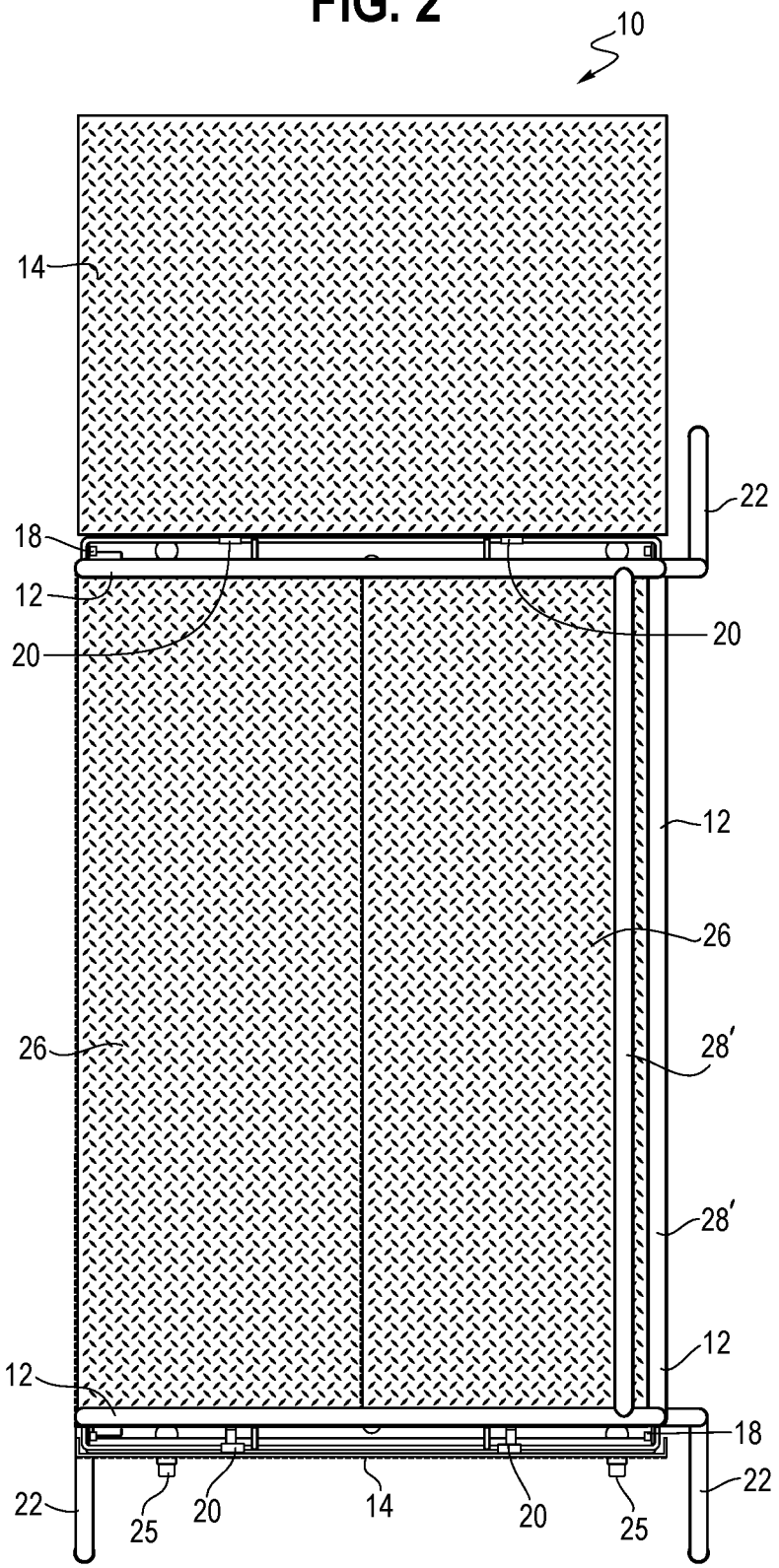
FIG. 2 is a top plan view of the ladder in question.
Figure 3:
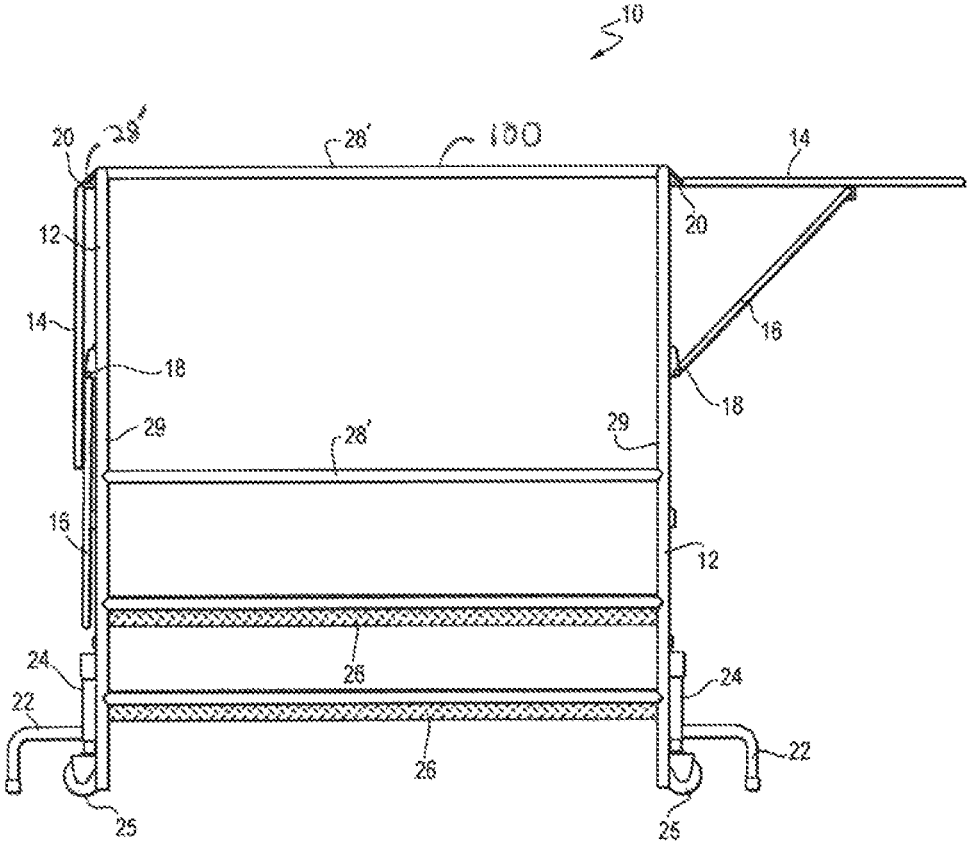
FIG. 3 is an elevation view of the back of the ladder.

The movable ladder 10, subject of the present application, consists of a structural frame 12, which has a rear part and two side faces, both the rear part 100 of the structure 12 and the side parts 102 have horizontal structural elements 28' and vertical structural elements 29. As shown in FIG. 1, each side part 102 has two vertical structural elements 29 and two horizontal structural elements 28'. Similarly, the rear part 100 includes rear horizontal structural elements 28' that extend from one side part 102 to the other side part 102. The structural elements 29 have in their lower part side projections 22 in the form of an inverted "U", which act like the legs of the ladder when in use, and keep the ladder firmly supported on the floor. Note that the legs 22, which to a certain extent constitute an extension of the structural elements 29, project slightly outwards, with the purpose of providing the ladder with greater stability.

As part of the structural elements of the ladder 12, object of the present invention, said ladder has two side platforms 14, which are suitably hinged to the side structural elements 28', by means of a pair of hinges 20, said platforms 14 are maintained in their horizontal position through the means identified with reference 16, which can be rotated downwards or upwards in the brackets 18. One of ordinary skill in the art will readily appreciate that said structural means 16 are hooked by the lower part of the platforms 14 when the use of them is required.

In the main FIG. 1, the collapse of the platforms 14 can be observed. To collapse the platform 14, the only thing needed to be done is to unhook the supporting means 16, by rotating it downwards as well as the respective platform 14. It is important to note that for the first time a movable ladder with two side platforms 14 having dimensions that may vary according to the intended use is offered to the market.

Figure 4:
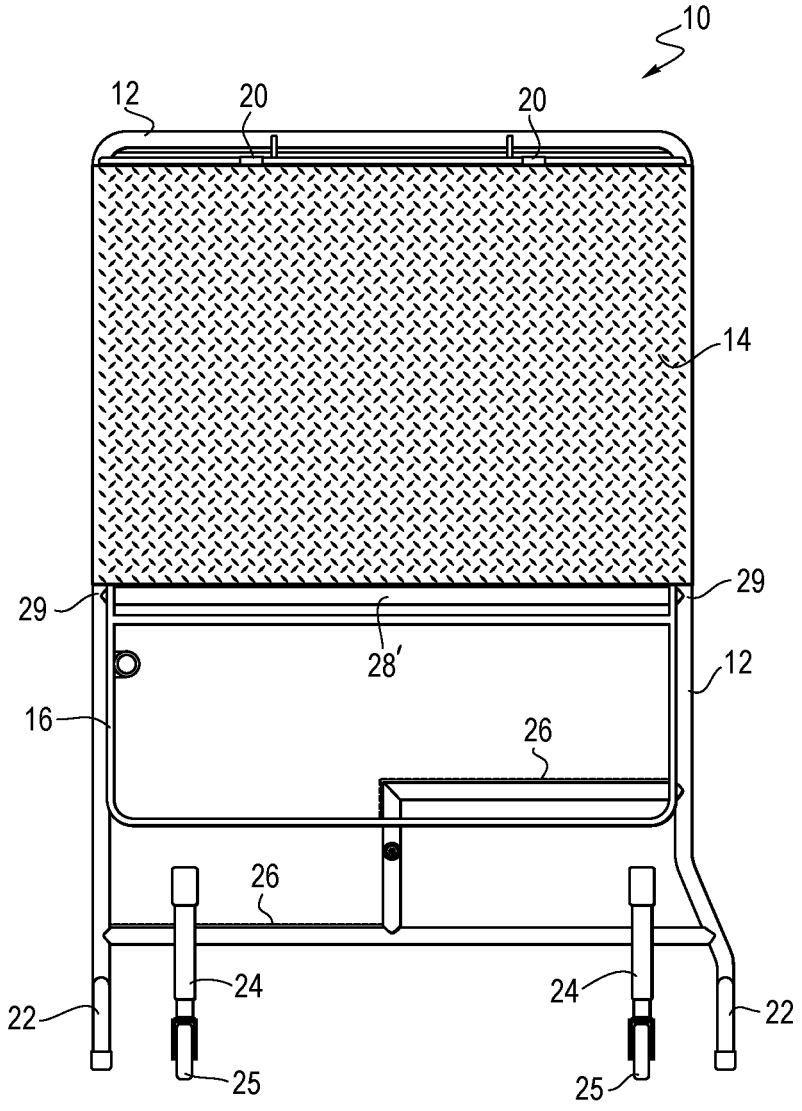
FIG. 4 is an elevation view of the right side of said ladder, with its platform collapsed.

From FIGS. 1 and 4, it is noted that said ladder is provided with four wheels or casters 25, which can be retracted or lowered, depending on whether said ladder 10 is being used or not. One of ordinary skill in the art with reference to the subject specification and figures will readily appreciate that when said ladder is in use, said casters 25 will have to be retracted such that said ladder 10 will have an adequate support on the floor by means of the side legs 22. Said casters 25 are fixedly and permanently mounted on the structural element 28, with the aid of the devices 24 which are no more than tubular elements either internally threaded or with perforations, for the insertion of a coach screw with the purpose of fixing the position of said casters 25.

Finally, it should be noted from the accompanying figures that the movable ladder of the invention has two steps 26 and 26'; the number of steps can vary according to the needs and use to which said ladder is intended.

From the detailed description that has been offered herein, it is evident that the objectives or purposes of the invention have been fully met and that due to the very particular structural configuration of the ladder of the invention, it offers advantages and has particular features that distinguish it from those of its kind.

Structural and design changes or modifications can be made to the movable ladder of the invention, without constituting a different invention, as long as the proposed changes are part of the invention subject matter and are within the spirit and scope of the claims that are offered below.

The invention claimed is:

1. A movable ladder comprising:

a structural frame comprising:

a first side part comprising:

a first vertical structural element, a second vertical structural element, and a first side horizontal structural element, where the first side horizontal structural element extends to the first vertical structural element and the second vertical structural element, and where the first vertical structural element comprises a first lateral projection and the second vertical structural element comprises a second lateral projection; and a second side part comprising:

a third vertical structural element, a fourth vertical structural element, and a second side horizontal structural element, where the second side horizontal structural element extends to the third vertical structural element and the fourth vertical structural element, and where the third vertical structural element comprises a third lateral projection and the fourth vertical structural element comprises a fourth lateral projection; and a rear horizontal structural element, where the rear horizontal structural element extends from the first side part to the second side part;

a first hinge disposed on the first side horizontal structural element;

a second hinge disposed on the second side horizontal structural element;

a first collapsible platform connected to the first side part via the first hinge;

a second collapsible platform connected to the second side part via the second hinge;

at least one caster connected to the structural frame; and at least two steps mounted to the structural frame;

a first support that supports the first collapsible platform in a first horizontal position;

a first bracket mounted to the first vertical structural element of the first side part, where a first end of the first support is inserted into the first bracket and where the first collapsible platform is maintained in the first horizontal position by rotating the first support upward within the first bracket and maintained in a first vertical position by rotating the first support downward within the first bracket, where the first collapsible platform extends away from an entirety of the structural frame while in the first horizontal position;

a second support that supports the second collapsible platform in a second horizontal position; and a second bracket mounted to the third vertical structural element of the second side part, where a second end of the second support is inserted into the second bracket and where the second collapsible platform is maintained in the second horizontal position by rotating the second support upward within the second bracket and maintained in a second vertical position by rotating the second support downward within the second bracket, where the second collapsible platform extends away from the entirety of the structural frame while in the second horizontal position.

2. The movable ladder of claim 1, further comprising:

a third side horizontal structural element connecting a bottom end of the first vertical structural element of the first side part to a bottom end of the second vertical structural element of the first side part; and a fourth side horizontal structural element connecting a bottom end of the third vertical structural element of the second side part to a bottom end of the fourth vertical structural element of the second side part.

3. The movable ladder of claim 2, where two casters are connected to the third side horizontal structural element.

4. The movable ladder of claim 2, where two casters are connected to the fourth side horizontal structural element.

5. The movable ladder of claim 1, where the first lateral projection comprises the shape of a substantially inverted u.

6. The movable ladder of claim 1, where the at least one caster can be lowered to move the movable ladder and raised such that movement of the movable ladder is substantially prevented.

7. The movable ladder of claim 1, further comprising a tubular element connecting the at least one caster to the structural frame.

8. The movable ladder of claim 1, where the first collapsible platform is positioned near a top of the first vertical structural element and a top of the second vertical structural element.

9. The movable ladder of claim 1, where the first side part is disposed substantially parallel to the second side part of the structural frame.

* * * * *